US005363591A

United States Patent [19]

Jones

[11] Patent Number: 5,363,591

[45] Date of Patent: Nov. 15, 1994

[54] PLANT STAND AND FEEDER

[76] Inventor: David A. Jones, 4304 Park Cir. Dr., Bakersfield, Calif. 93309

[21] Appl. No.: 48,215

[22] Filed: Apr. 20, 1993

[51] Int. Cl.[5] ..... A47G 7/02

[52] U.S. Cl. ..... 47/40.5; 248/524

[58] Field of Search ..... 47/40.5; 248/519, 523, 248/524, 528

[56] References Cited

U.S. PATENT DOCUMENTS

| | | | |
|---|---|---|---|
| 1,695,275 | 12/1928 | Davis | 248/523 |
| 3,227,405 | 1/1966 | Layton | 248/524 |
| 3,353,773 | 11/1967 | Budd | 248/524 |
| 3,405,896 | 10/1968 | Eby | 248/524 |
| 3,733,040 | 5/1973 | Rocquin | 248/524 |
| 4,190,983 | 3/1980 | Rostomily | 248/523 |
| 4,429,846 | 2/1984 | Halvorson | 248/524 |
| 4,653,224 | 3/1987 | Weckesser | 47/40.5 |
| 4,889,309 | 12/1989 | McCure | 248/524 |
| 4,993,176 | 2/1991 | Spinosa | 47/40.5 |
| 5,002,252 | 3/1991 | Setala et al. | 248/523 |

*Primary Examiner*—Ramon S. Britts
*Assistant Examiner*—Joanne C. Downs
*Attorney, Agent, or Firm*—Robert M. Sperry

[57] ABSTRACT

An improved plant stand comprising a reservoir having an open top for receiving the base or ball of a plant at least one base member projecting outwardly from said reservoir, a plurality of jam-cleats each mounted adjacent the outer end of a portion of said base member, a retaining member encircling said plant at a desired elevation above the top of said reservoir, a plurality of support lines each having one end connected to a respective location about said retaining member and having the other end clamped by a respective one of said jam-cleats, a fluid supply tank having a hose of sufficient length to allow said tank to be located beyond the branches of a plant mounted in said reservoir and communicating with said reservoir to enable fluid from said supply tank to flow into said reservoir.

10 Claims, 2 Drawing Sheets

PLANT STAND AND FEEDER

BACKGROUND

FIELD OF INVENTION

This invention relates to plant stands and is particularly directed to supports for balled or cut trees, such as Christmas trees, and means for supplying water and other nutrients to the supported tree.

PRIOR ART

It is common practice to use trees, which are cut or which have the roots balled, as Christmas decorations and for other purposes, such as weddings, stage plays, motion picture sets and the like. Obviously, when this is done, some means must be provided for supporting the trees in an upright position. Furthermore, if the trees are to be kept for an extended period of time, some means must be provided for supplying the trees with water and other nutrients. Numerous types of supports for cut trees have been proposed in the prior art. However, most of these do not provide for watering or feeding the trees. This causes the trees to become dry and brittle and presents severe fire hazards. Other prior art tree stands do provide bucket type means for watering the cut trees, but require that the user crawl under the tree and stick their finger into the reservoir in order to replenish the water supply and must keep their finger in the reservoir while they fill the reservoir to prevent spillage. This is inconvenient and often difficult for the user and may result in the user upsetting the tree, in attempting to crawl under it, which may cause injury or damage to the user, the tree, ornaments on the tree or nearby furniture, Also, if there are electric lights on the tree, such upsetting can lead to sparks and fire, which can imperil the entire building, Furthermore, many prior art tree stands are designed for quick and easy assembly and give little thought to stability or safety, In consequence, such tree stands are highly unstable and dangerous, Other prior art tree stands have been expensive to purchase and have been complex and difficult to install. Thus, none of the prior art tree stands have been entirely satisfactory.

BRIEF SUMMARY AND OBJECTS OF INVENTION

These disadvantages of prior art tree stands are overcome with the present invention and an improved tree stand is provided which can be installed quickly and easily, yet provides a safe and stable support for the tree and which enables the user to supply water and other nutrients to the tree without crawling under the tree.

The advantages of the present invention are preferably attained by providing an improved tree stand comprising a reservoir having an open top for receiving the base or ball of a tree, at least one base member projecting outwardly from said reservoir, a plurality of jam-cleats each mounted adjacent the outer end of a portion of said base member, a retaining member encircling said plant at a desired elevation above the top of said reservoir, a plurality of support lines each having one end connected to a respective location about said retaining member and having the other end clamped by a respective one of said jam-cleats, a fluid supply tank having a hose of sufficient length to allow said tank to be located beyond the branches of a plant mounted in said reservoir and communicating with said reservoir to enable fluid from said supply tank to flow into said reservoir.

Accordingly, it is an object of the present invention to provide an improved tree stand.

Another object of the present invention is to provide an improved tree stand including means for supplying water and other liquid nutrients to a tree supported therein.

An additional object of the present invention is to provide an improved tree stand including means for supplying water and other liquid nutrients to a tree supported therein which does not require the user to crawl under the tree in order to replenish the liquid supply in the reservoir, A further object of the present invention is to provide an improved tree stand which can be installed quickly and easily, yet provide a safe and secure support for the tree.

A specific object of the present invention is to provide an improved tree stand comprising a reservoir having an open top for receiving the base or ball of a tree, at least one base member projecting outwardly from said reservoir, a plurality of jam-cleats each mounted adjacent the outer end of a portion of said base member, a retaining member encircling said plant at a desired elevation above the top of said reservoir, a plurality of support lines each having one end connected to a respective location about said retaining member and having the other end clamped by a respective one of said jam-cleats, a fluid supply tank having a hose of sufficient length to allow said tank to be located beyond the branches of a plant mounted in said reservoir and communicating with said reservoir to enable fluid from said supply tank to flow into said reservoir.

These and other objects and features of the present invention will be apparent from the following detailed description, taken with reference to the figures of the accompanying drawing.

DETAILED DESCRIPTION OF THE INVENTION

Figure 1:
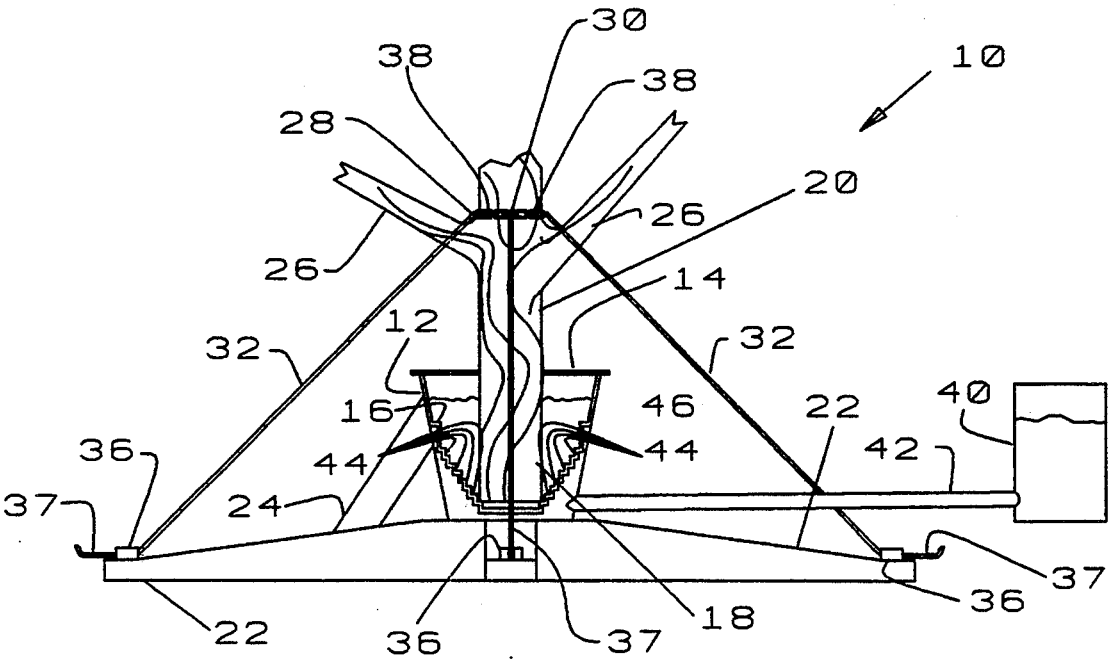
FIG. 1 is a side view, partly in section, of a tree stand embodying the present invention.
Figure 2:
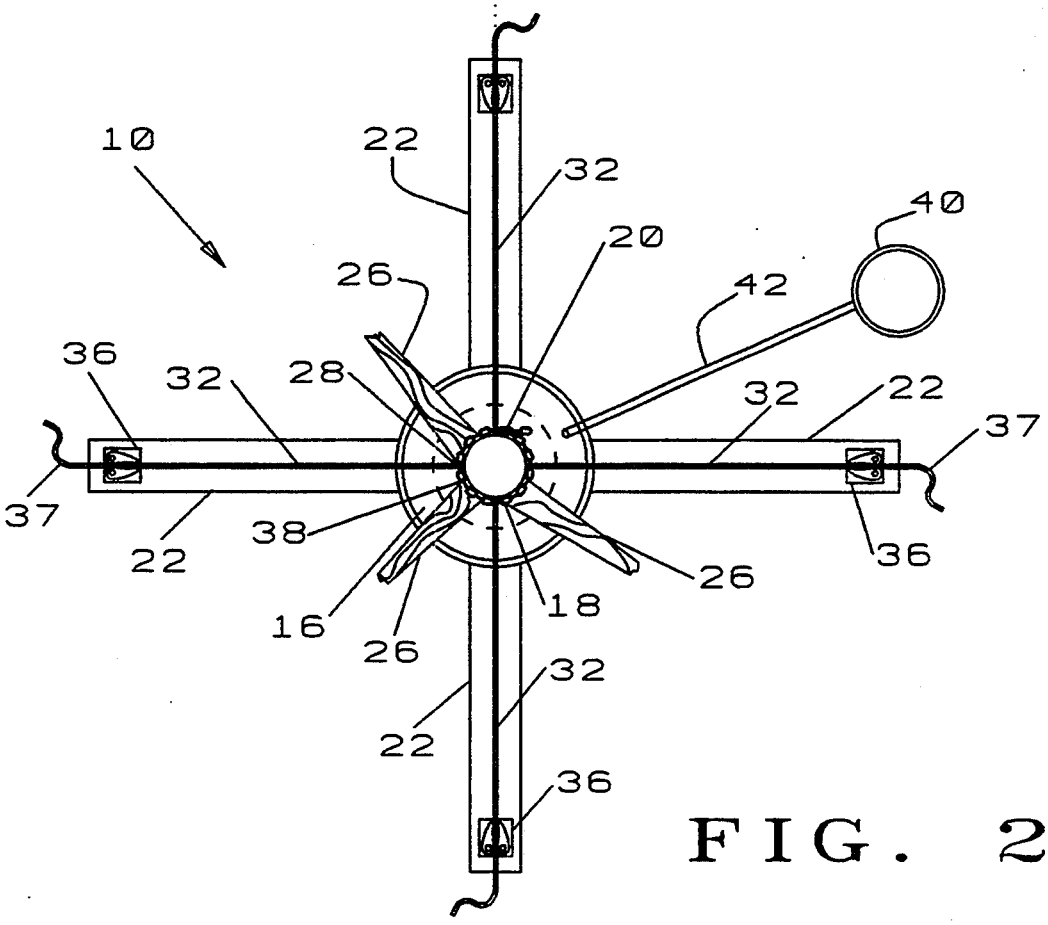
FIG. 2 is a top view of the tree stand of FIG. 1.

In that form of the present invention chosen for purposes of illustration in the drawing, FIGS. 1 and 2 show a tree stand, indicated generally at 10, having central, generally cylindrical reservoir member 12 having an open upper end 14 and formed with an annularly stepped insert 16 for receiving the cut trunk 18 of a tree 20 and assisting to position tree trunks of various sizes. Preferably, the diameter of the cylindrical member 12 will be sufficient to permit insertion of a balled root, not shown, for the tree 20, instead of the cut trunk 18. As best seen in FIG. 2, a plurality of base members 22 project outwardly from the central member 12 and, if desired, braces 24 may be provided extending from the base members 22 to the exterior of the central member 12 adjacent the open upper end 14. The tree 20 has a plurality of lower branches 26 extending outwardly from the trunk 18 and a flexible member, such as chain 28, is fastened tightly about the tree 20 above the lower branches 26. Suitable fastening means, such as hook 30 are provided to enable the chain 28 to be firmly secured about the trunk 18 of the tree 20 above the lower branches 26 and a plurality of flexible support members 32, such as ropes, cables or the like, each have one end 34 releasably attached to the chain 28 and have the opposite end secured by a releasable retaining member 36, such as a jam-cleat, mounted adjacent the outer end of a respective one of the base members 22. Preferably, a plurality of lengths of tubing 38 are mounted on the chain 28 between the support members 32 to prevent the chain 28 from chafing the tree 20. Finally, a fluid supply tank 40 is provided and is connected by a hose 42 to supply fluid into the cylindrical member 12. The stepped insert 16 is formed with a plurality of openings 44 to allow free flow of fluid from the supply tank and hose 42 to a desired level 46 within the cylindrical member 12. As shown, the hose 42 is of sufficient length to allow the supply tank 40 to be located beyond the spread of the branches 26 and, hence, to allow the user to easily observe the level of fluid in the supply tank 40 and, when necessary or desirable, to replenish the fluid in the supply tank 40 without crawling under the branches 26.

In use, the trunk 18 of the tree 20 is placed in stepped insert 16 through the open upper end 14 of the cylindrical member 12 and the chain 28 is wrapped about the trunk 18 above the lower branches 26 of the tree and is releasably secured by hook 30 or the like. A plurality of flexible support members 32 each have one end attached to the chain 28 at spaced intervals and tubing sections 38 encircle the chain 28 between the support members 32 to prevent chafing of the tree 20. The opposite ends 37 of the support members 32 are each drawn through a respective one of the jam-cleats 36 to releasably retain the support members 32 and to retain the tree 20 in its erected position. By suitably adjusting the lengths of the support members 32, the position of the tree 20 may be adjusted to assure that the tree 20 is properly erected. Finally, the fluid supply tank 40 is connected to the cylindrical member 12 by hose 42 and is positioned beyond the branches 26. Thereafter, a quantity of water or other liquid nutrients may be supplied, through the supply tank 40 and hose 42, to the interior of the cylindrical member 12 to feed the tree 20. Since the supply tank 40 is located beyond the spread of the branches 26, the user can easily observe and replenish the fluid supply in the supply tank 40, as needed, without crawling under the branches 26. This relieves the user of considerable stooping and crawling and avoids the danger of upsetting the tree 20.

Figure 3:
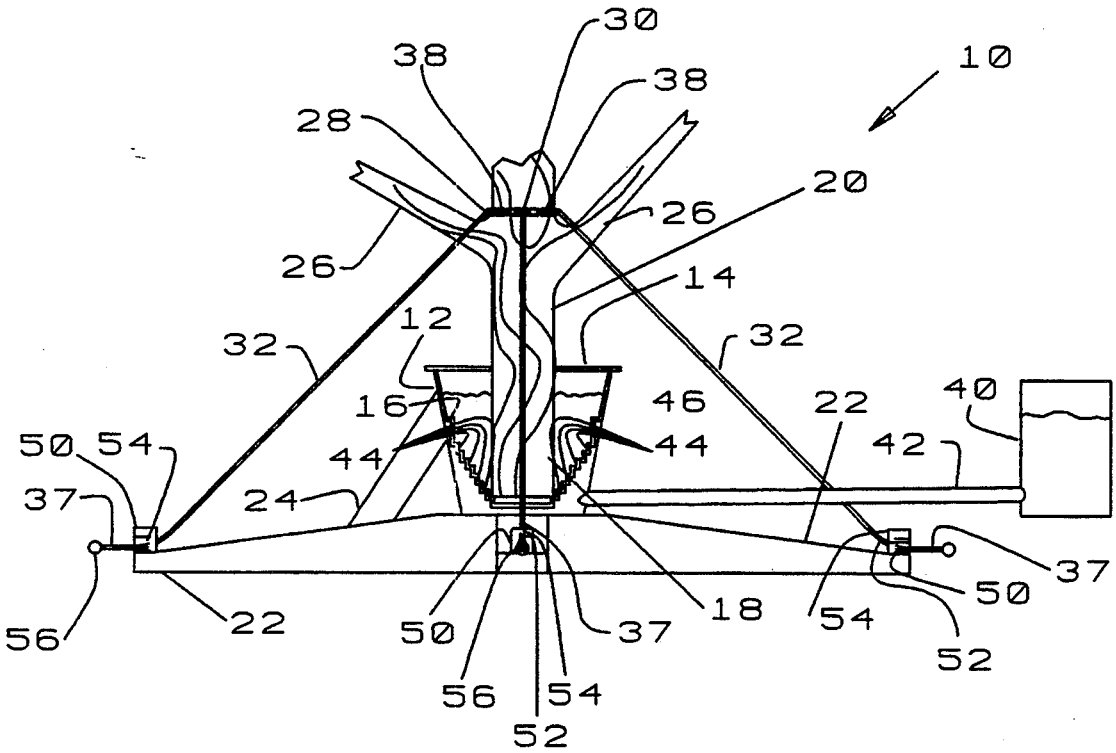
FIG. 3 is a view, similar to that of FIG. 1, showing an alternative form of jam-cleat for the tree stand of FIG. 1.

FIG. 3 shows an alternative form of the tree stand 10 wherein the jam-cleats 36 are replaced by upwardly-extending plates 50 having convexly curved slots 52 formed in the upper edges 54 of the plates 50 to releasably receive and retain the ends 37 of the support members 32. If desired, suitable stop means, such as balls 56, may be secured to the ends 37 of the support members 32 to assure that the ends 37 cannot slip through the slots 52.

Obviously, numerous other variations and modifications can also be made without departing from the spirit of the present invention. Therefore, it should be clearly understood that the forms of the present invention described above and shown in the figures of the accompanying drawing are illustrative only and are not intended to limit the scope of the present invention.

What is claimed is:

1. A plant stand comprising:

a reservoir member having an open upper end for receiving a plant, at least one base member projecting outwardly from said reservoir member to provide a support therefore, a plurality of releasable retaining means, each mounted adjacent the outer end of a portion of said base member, a flexible member releasably securable to tightly encircle said plant, a plurality of flexible support members each having one end attached to said flexible member and having the opposite end engaged by said retaining means, a fluid supply tank adapted to be mounted on the same level with said reservoir, and a hose connecting a lower portion of said tank to a lower portion of said reservoir, said hose being inclined downwardly from said tank to said reservoir thereby relying upon gravity to supply fluid into said reservoir to a height just equal to that of the fluid in said reservoir and being of sufficient length to allow said tank to be located beyond the branches of said plant.

2. The plant stand of claim 1 wherein:

said releasable retaining means are jam-cleats.

3. The plant stand of claim 1 wherein:

said flexible member is a chain.

4. The plant stand of claim 1 further comprising:

a plurality of tubing sections encircling said flexible member between said support members.

5. The plant stand of claim 1 further comprising:

a stepped insert mounted within said reservoir to assist in positioning tree trunks of various sizes.

6. The plant stand of claim 5 wherein:

said insert is formed with a plurality of openings to facilitate fluid flow therethrough.

7. The plant stand of claim 1 wherein:

said retaining means are upwardly-extending plates each formed with a slot having convex sides.

8. A plant stand comprising:

a reservoir member having an open upper end for receiving a plant, at least one base members, projecting outwardly from said reservoir member to provide a support therefore, a plurality of releasable retaining means, each mounted adjacent the outer end of a portion of said base member, a flexible member releasably securable to tightly encircle said plant, a plurality of flexible support members each having one end attached to said flexible member and having the opposite end engaged by said retaining means, and a plurality of tubing sections encircling said flexible member between said support members.

9. A plant stand comprising:

a reservoir member having an open upper end for receiving a plant, at least one base member projecting outwardly from said reservoir member to provide a support therefore, a plurality of releasable retaining means, each mounted adjacent the outer end of a portion of said base member, a flexible member releasably securable to tightly encircle said plant, a plurality of flexible support members each having one end attached to said flexible member and having the opposite end engaged by said retaining means, a stepped insert mounted within said reservoir to assist in positioning tree trunks of various sizes.

10. The plant stand of claim 9 wherein:

said insert is formed with a plurality of openings in said insert to facilitate fluid flow through said insert.

* * * * *